US009151488B2

(12) United States Patent
Magee

(10) Patent No.: US 9,151,488 B2
(45) Date of Patent: Oct. 6, 2015

(54) START-UP SYSTEM FOR A ONCE-THROUGH HORIZONTAL EVAPORATOR

(71) Applicant: Alstom Technology Ltd., Braden (CH)

(72) Inventor: Jeffrey F. Magee, Longmeadow, MA (US)

(73) Assignee: ALSTOM Technology Ltd, Baden (CH)

( * ) Notice: Subject to any disclaimer, the term of this patent is extended or adjusted under 35 U.S.C. 154(b) by 381 days.

(21) Appl. No.: 13/744,104

(22) Filed: Jan. 17, 2013

(65) Prior Publication Data

US 2013/0180681 A1 Jul. 18, 2013

Related U.S. Application Data

(60) Provisional application No. 61/587,332, filed on Jan. 17, 2012, provisional application No. 61/587,428, filed on Jan. 17, 2012, provisional application No. 61/587,359, filed on Jan. 17, 2012, provisional application No. 61/587,402, filed on Jan. 17, 2012.

(51) Int. Cl.

| | |
|---|---|
| ***F22D 5/26*** | (2006.01) |
| ***F22B 29/06*** | (2006.01) |
| ***F22D 5/34*** | (2006.01) |

(Continued)

(52) U.S. Cl.

CPC ..... *F22B 29/06* (2013.01); *F22B 15/00* (2013.01); *F22D 5/34* (2013.01); *F28D 7/082* (2013.01); *F28F 1/00* (2013.01); *F28F 9/013* (2013.01); *F28F 9/0275* (2013.01); *F28F 9/22* (2013.01); *F28F 9/26* (2013.01); *Y10T 137/0324* (2015.04)

(58) Field of Classification Search

CPC ..... F22B 15/00

USPC ..... 122/406.4, 439, 448.4, 448.2, 451 S, 122/479.7, 488

See application file for complete search history.

(56) References Cited

U.S. PATENT DOCUMENTS

| | | | |
|---|---|---|---|
| 505,735 | A | 9/1893 | Vanes |
| 1,884,778 | A | 10/1932 | Lucke et al. |

(Continued)

FOREIGN PATENT DOCUMENTS

| | | | |
|---|---|---|---|
| CN | 2420739 | Y | 5/2001 |
| DE | 612 960 | | 5/1935 |

(Continued)

*Primary Examiner* — Gregory A Wilson

(74) *Attorney, Agent, or Firm* — Robert D. Crawford

(57) ABSTRACT

Disclosed herein is a once-through evaporator comprising an inlet manifold; one or more inlet headers in fluid communication with the inlet manifold; one or more tube stacks, where each tube stack comprises one or more substantially horizontal evaporator tubes; the one or more tube stacks being in fluid communication with the one or more inlet headers; where one or more tube stacks are used for a start-up of the once-through evaporator; one or more outlet headers in fluid communication with one or more tube stacks; a separator in fluid communication with the one or more outlet headers; a first flow control device in fluid communication with the separator and at least one of the tube stacks used for startup; a second flow control device in fluid communication with a superheater to bypass the separator and at least one of the tube stacks used for startup; and a controller for controlling the actuation of the first and second flow control devices in response to a parameter of the evaporator.

20 Claims, 4 Drawing Sheets

(51) Int. Cl.

| | |
|---|---|
| ***F28F 1/00*** | (2006.01) |
| ***F28F 9/013*** | (2006.01) |
| ***F28F 9/22*** | (2006.01) |
| ***F28F 9/26*** | (2006.01) |
| ***F28D 7/08*** | (2006.01) |
| ***F22B 15/00*** | (2006.01) |
| ***F28F 9/02*** | (2006.01) |

(56) References Cited

U.S. PATENT DOCUMENTS

| | | | | |
|---|---|---|---|---|
| 2,800,887 | A * | 7/1957 | Profos | 122/448.4 |
| 3,004,529 | A * | 10/1961 | Argersinger et al. | 122/448.1 |
| 3,789,806 | A | 2/1974 | Gorzegno | |
| 4,336,642 | A | 6/1982 | Engelberts | |
| 4,915,062 | A | 4/1990 | Dolezal | |
| 5,398,644 | A * | 3/1995 | Nilsson et al. | 122/406.4 |
| 6,173,679 | B1 * | 1/2001 | Bruckner et al. | 122/406.4 |
| 6,189,491 | B1 | 2/2001 | Wittchow et al. | |
| 6,868,807 | B2 | 3/2005 | Franke et al. | |
| 6,957,630 | B1 | 10/2005 | Mastronarde | |
| 7,770,544 | B2 | 8/2010 | Viskup, Jr. | |
| 7,963,097 | B2 | 6/2011 | Mastronarde | |
| 2003/0051501 | A1 | 3/2003 | Matsushima et al. | |
| 2004/0069244 | A1 | 4/2004 | Schroeder | |
| 2007/0084418 | A1 * | 4/2007 | Gurevich | 122/1 B |
| 2008/0190382 | A1 * | 8/2008 | Bruckner et al. | 122/7 R |
| 2009/0241859 | A1 * | 10/2009 | Bairley et al. | 122/235.15 |
| 2011/0162594 | A1 | 7/2011 | Bruckner et al. | |
| 2011/0239961 | A1 * | 10/2011 | Bauver et al. | 122/7 R |
| 2012/0180739 | A1 * | 7/2012 | Rop et al. | 122/7 R |
| 2014/0216365 | A1 * | 8/2014 | Rancruel et al. | 122/7 R |

FOREIGN PATENT DOCUMENTS

| | | |
|---|---|---|
| GB | 865426 | 4/1961 |
| KR | 10-0284392 | 4/2001 |
| WO | 2007/133071 | 11/2007 |

* cited by examiner

START-UP SYSTEM FOR A ONCE-THROUGH HORIZONTAL EVAPORATOR

CROSS-REFERENCE TO RELATED APPLICATIONS

This disclosure claims priority to U.S. Provisional Application No. 61/587,332 filed Jan. 17, 2012, U.S. Provisional Application No. 61/587,428 filed Jan. 17, 2012, U.S. Provisional Application No. 61/587,359 filed Jan. 17, 2012, and U.S. Provisional Application No. 61/587,402 filed Jan. 17, 2012, the entire contents of which are all hereby incorporated by reference.

TECHNICAL FIELD

The present disclosure relates generally to a heat recovery steam generator (HRSG), and more particularly, to a start-up system in an HRSG having substantially horizontal and/or horizontally inclined tubes for heat exchange.

BACKGROUND

A heat recovery steam generator (HRSG) is an energy recovery heat exchanger that recovers heat from a hot gas stream. It produces steam that can be used in a process (co-generation) or used to drive a steam turbine (combined cycle). Heat recovery steam generators generally comprise four major components—the economizer, the evaporator, the superheater and the water preheater. In particular, natural circulation HRSG's contain an evaporator heating surface, a drum, as well as piping to facilitate an appropriate circulation rate in the evaporator tubes. A once-through HRSG replaces the natural circulation components with the once-through evaporator and in doing so offers in-roads to higher plant efficiency and furthermore assists in prolonging the HRSG lifetime in the absence of a thick walled drum.

An example of a once-through evaporator heat recovery steam generator (HRSG) 100 is shown in the FIG. 1. In the FIG. 1, the HRSG comprises vertical heating surfaces in the form of a series of vertical parallel flow paths/tubes (disposed between the duct walls 111) configured to absorb the required heat to form a first heat exchanger 104 and a second heat exchanger 108. In the HRSG 100, a working fluid (e.g., water) is transported to an inlet manifold 105 from a source 106. The working fluid is fed from the inlet manifold 105 to an inlet header 112 and then to the first heat exchanger 104, where it is heated by hot gases from a furnace (not shown) flowing in the horizontal direction. The hot gases heat tube sections of the first and second heat exchangers 104 and 108 disposed between the duct walls 111. A portion of the heated working fluid is converted to a vapor and the mixture of the liquid and vaporous working fluid is transported to the outlet manifold 103 via the outlet header 113, from where it is transported to a mixer 102, where the vapor and liquid are mixed once again and distributed to the second heat exchanger 108. This separation of the vapor from the liquid working fluid is undesirable as it produces temperature gradients and efforts have to be undertaken to prevent it. To ensure that the vapor and the fluid from the heat exchanger 104 are well mixed, they are transported to a mixer 102, from which the two phase mixture (vapor and liquid) are transported to the second heat exchanger 108 where they are subjected to superheat conditions. The second heat exchanger 108 is used to overcome thermodynamic limitations. The vapor and liquid are then discharged to a collection vessel 109 from which they are then sent to a separator 110, prior to being used in power generation equipment (e.g., a turbine). The use of vertical heating surfaces thus has a number of design limitations.

A common design consideration for boiler equipment is of the number of cold, warm, and hot starts a plant can accommodate over a period of time. The specific combination of these conditions directly relates to the equipment lifetime due to the adverse effects inherent in the daily thermal cycling of thick-walled pressure vessel equipment subjected to these drastic temperature changes. Often, thick walled equipment begins to fail as a result of prolonged thermal cycling. To prevent such failure, critical equipment must be identified and evaluated to ensure that operational demand can be satisfied. These evaluations necessitate additional inspections and maintenance, resulting in the loss of time and productivity.

It is also desirable to have as much operational flexibility as is desirable for combined cycle power plants because these power plants are often shut down and restarted as electrical power demand varies. The addition of renewable energy sources such as solar and wind increases the need to shut down and restart combined cycle power plants due to the variation in power output from such renewable resources. Stresses in various components of the HRSG due to thermal transients during these startups can limit the total number of times the heat recovery steam generators can be shut down and started over its operational life. It is therefore desirable to reduce the temperature transients in the components associated with the HRSG.

SUMMARY

Disclosed herein is a once-through evaporator comprising an inlet manifold; one or more inlet headers in fluid communication with the inlet manifold; one or more tube stacks, where each tube stack comprises one or more substantially horizontal evaporator tubes; the one or more tube stacks being in fluid communication with the one or more inlet headers; where one or more tube stacks are used for a start-up of the once-through evaporator; one or more outlet headers in fluid communication with one or more tube stacks; a separator in fluid communication with the one or more outlet headers; a first flow control device in fluid communication with the separator and at least one of the tube stacks used for startup; a second flow control device in fluid communication with a superheater to bypass the separator and at least one of the tube stacks used for startup; and a controller for controlling the actuation of the first and second flow control devices in response to a parameter of the evaporator.

Disclosed herein too is a method comprising discharging a working fluid through a once-through evaporator; where the once-through evaporator comprises an inlet manifold; one or more inlet headers in fluid communication with the inlet manifold; one or more tube stacks, where each tube stack comprises one or more substantially horizontal evaporator tubes; the one or more tube stacks being in fluid communication with the one or more inlet headers; where one or more tube stacks are used for a start-up of the once-through evaporator; one or more separators in fluid communication with one or more tube stacks; a separator in fluid communication with the one or more outlet headers; a first flow control device in fluid communication with the separator and at least one of the tube stacks used for startup; a second flow control device in fluid communication with a superheater to bypass the separator and at least one of the tube stacks used for startup; and a controller for controlling the actuation of the first and second flow control devices in response to a parameter of the evaporator; measuring a temperature of the working fluid in the tube stack; and controlling and opening of the first flow control device and/or the second flow control device based on the temperature of the working fluid in the tube stack.

BRIEF DESCRIPTION OF THE DRAWINGS

Referring now to the Figures, which are exemplary embodiments, and wherein the like elements are numbered alike.

DETAILED DESCRIPTION

Disclosed herein is a system and a method for starting up a heat recovery steam generator (HRSG) that comprises a single heat exchanger or a plurality of heat exchangers whose tubes are arranged to be either horizontal and/or non-vertical. By non-vertical, it is implied the tubes are inclined at an angle to a vertical. By "inclined", it is implied that the individual tubes are inclined at an angle less than 90 degrees or greater than 90 degrees to a vertical line drawn across a tube. In one embodiment, the tubes can be horizontal in a first direction and inclined in a second direction that is perpendicular to the first direction. A horizontal tube is inclined at 90 degrees±2 degrees to the vertical.

As noted above, there is a limitation to the number of cold, warm and hot starts that a plant can accommodate over a period of time. It is therefore desirable to increase the operating life cycle of the plant by providing a system and a method for starting up the heat recovery steam generator and associated equipment.

In one embodiment, the start-up method comprises providing dry steam (in reduced amounts when compared with amounts normally delivered) to the desired components (e.g., components that are negatively affected by rapid temperature changes), such as, for example, the superheater separator, during the early startup phase. The dry steam gradually warms up the desired components thus reducing the temperature gradient across the component and reducing stresses that damage the component.

One of the issues with using small amounts of dry steam to gradually heat these components involves a mass flow turndown. Once-through evaporators can handle a permissible massflow turndown. While a properly designed drum-type evaporator can generate steam at very low plant loads (roughly 8%) without restriction, a once-through evaporator necessitates a minimum flow setting, typically specified by the boiler designer in order to ensure proper operation and protection of the once-through section. The specific minimum flow setting can in turn cause delayed steam generation, offset the once-through operation mode, and curtail the supply of steam to said downstream equipment. In order to overcome this problem, a system is provided for permitting for further reduction of the minimum flow value so as to provide steam more quickly to the downstream equipment and thus increase the equipment life. Moreover, this steam can also facilitate a faster plant ramp rate as warming of the steam turbine can also begin more quickly.

Figure 1:
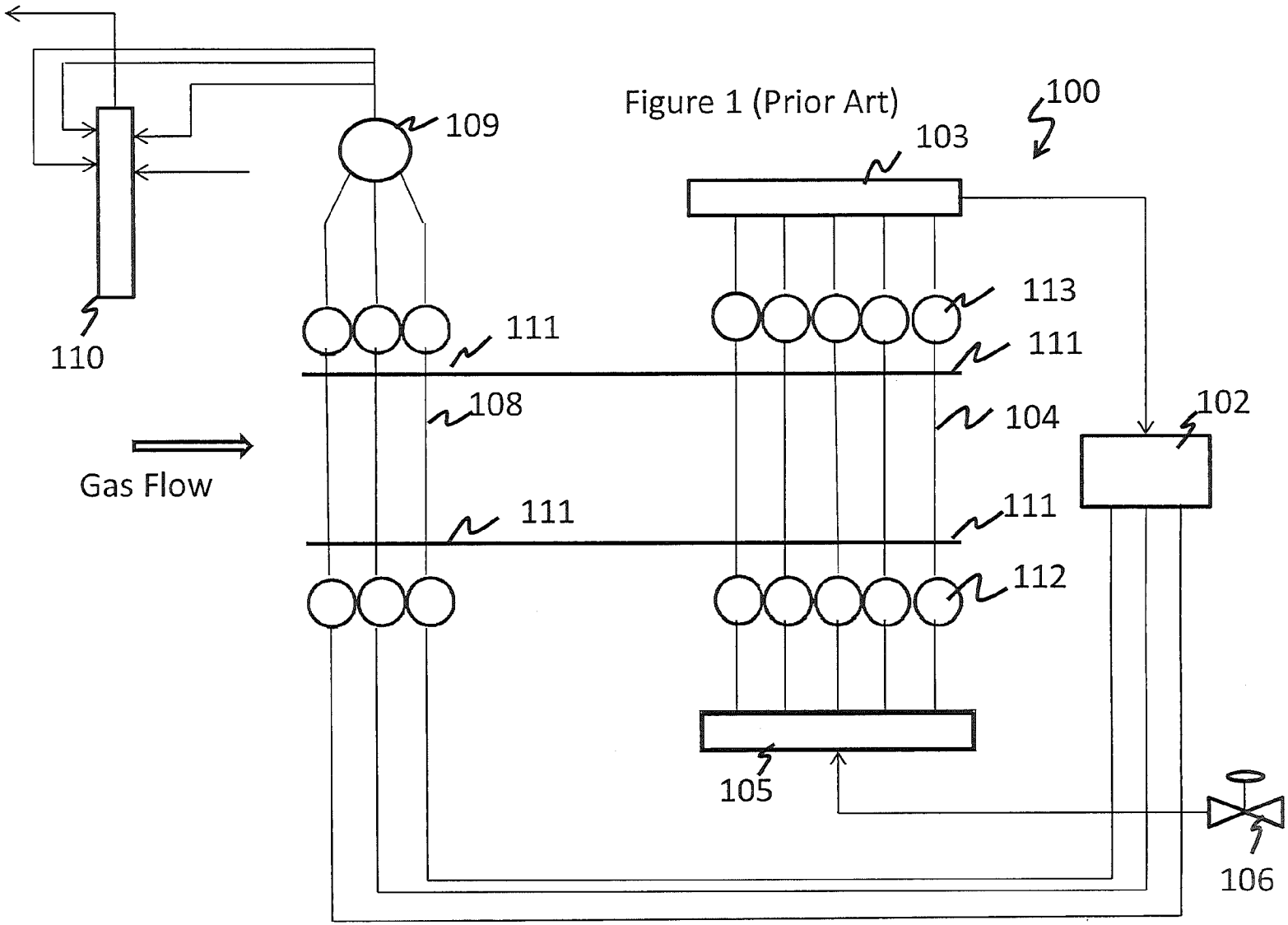
Figure 1 (Prior Art)
FIG. 1 is a schematic view of a prior art heat recovery steam generator having vertical heat exchanger tubes.
Figure 2:
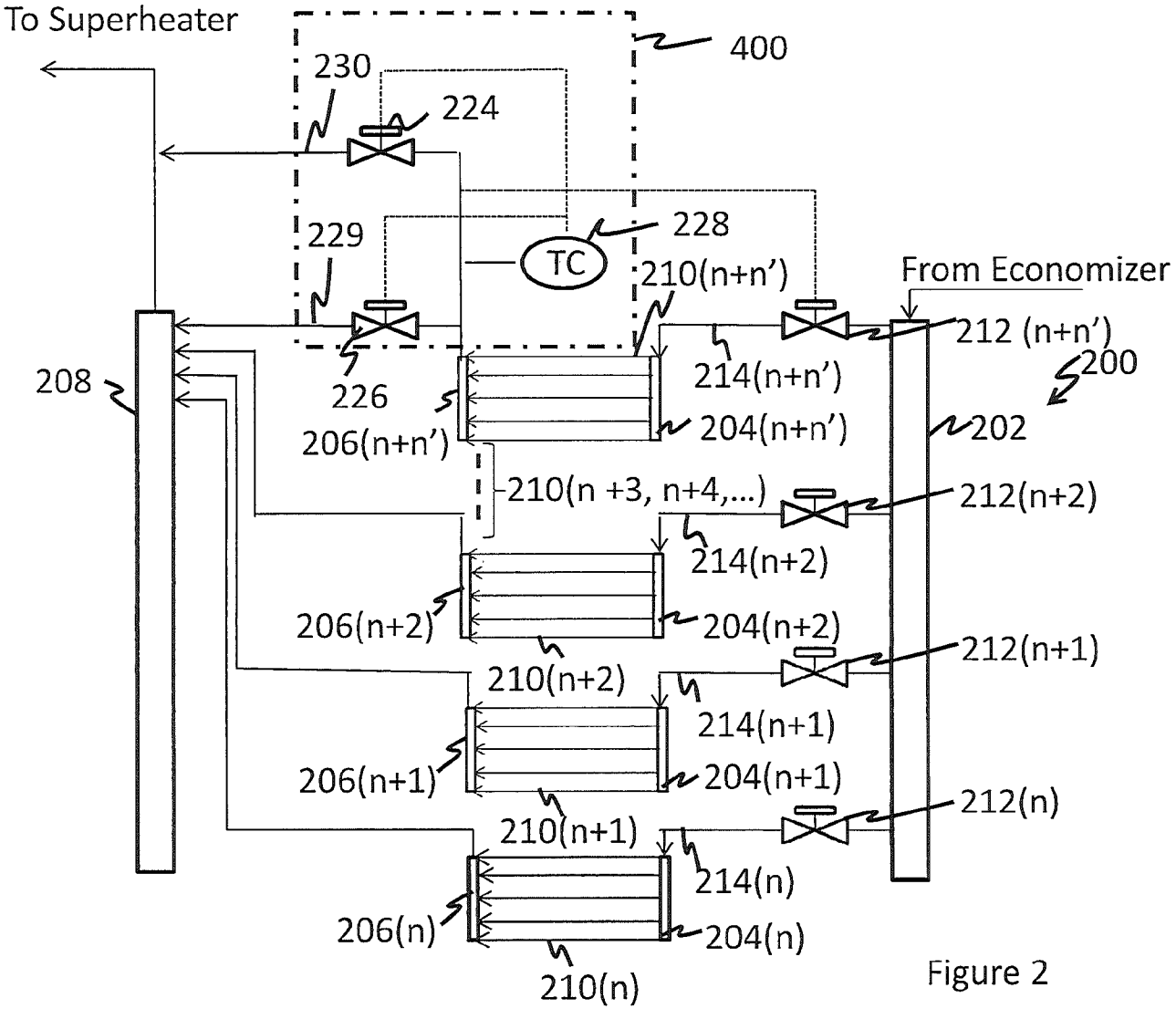
FIG. 2 depicts a schematic view of an exemplary once-through evaporator that uses control valves in an open loop control system.

FIG. 2 shows a "startup" system for a once-through evaporator 200 that has tube stacks 210(*n*) comprising substantially horizontal tubes. As noted above, the tubes can also be inclined in a first direction and in a second direction, where the second direction is perpendicular to the first direction. The once-through evaporator (hereinafter "evaporator") of the FIG. 2 comprises parallel tubes that are disposed horizontally in a direction that is perpendicular to the direction of flow of heated gases emanating from a furnace or boiler.

Figures 3A, 3B:
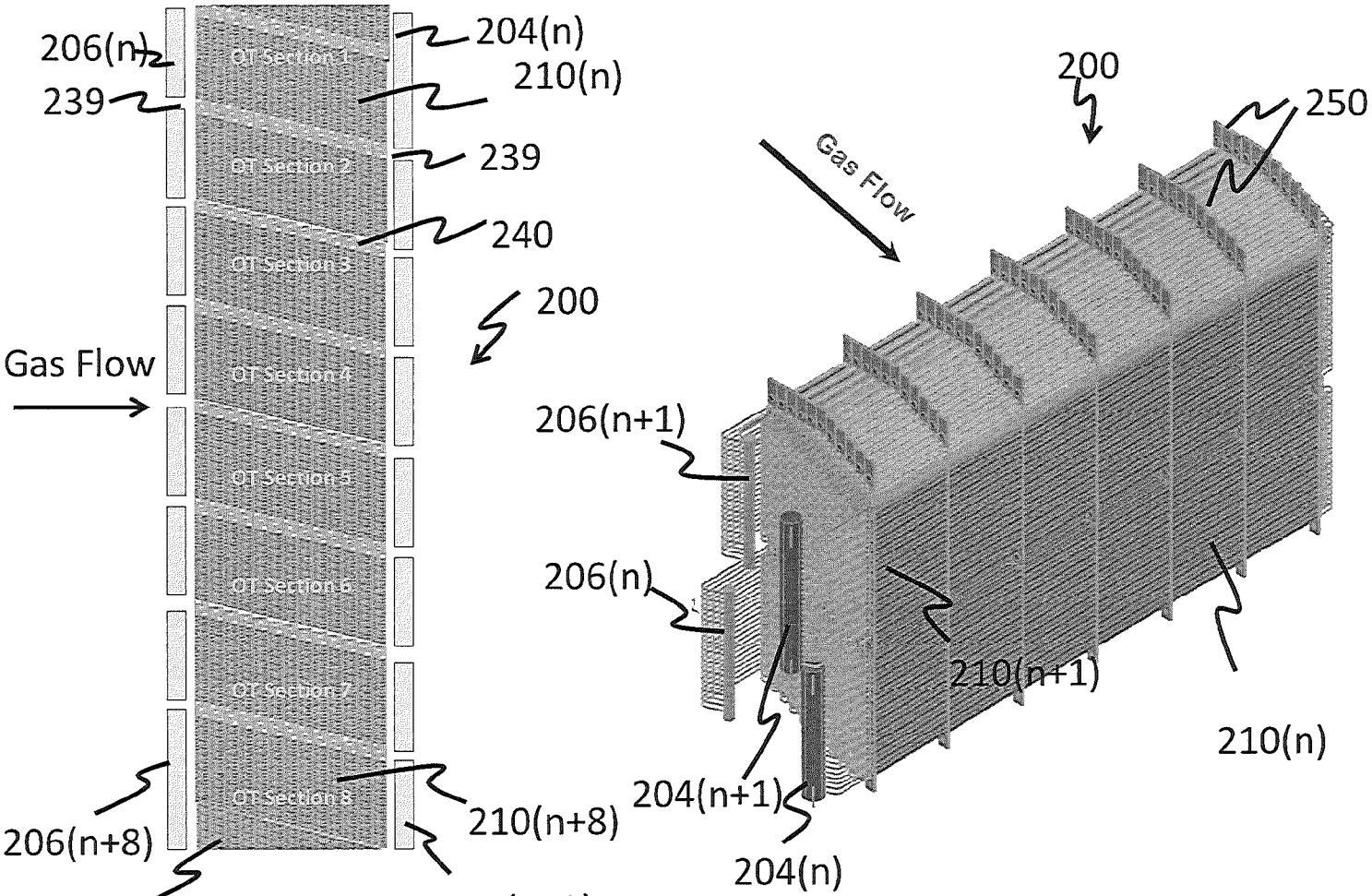
FIG. 3(A) is a depiction of a once-through evaporator that contains 8 tube stacks, and which depicts the flow of the hot gases relative to the tube stacks.
FIG. 3(B) is an isometric view of a once-through evaporator that comprises two tube stacks and shows plates that support the tubes in each tube stack.
Figure 4:
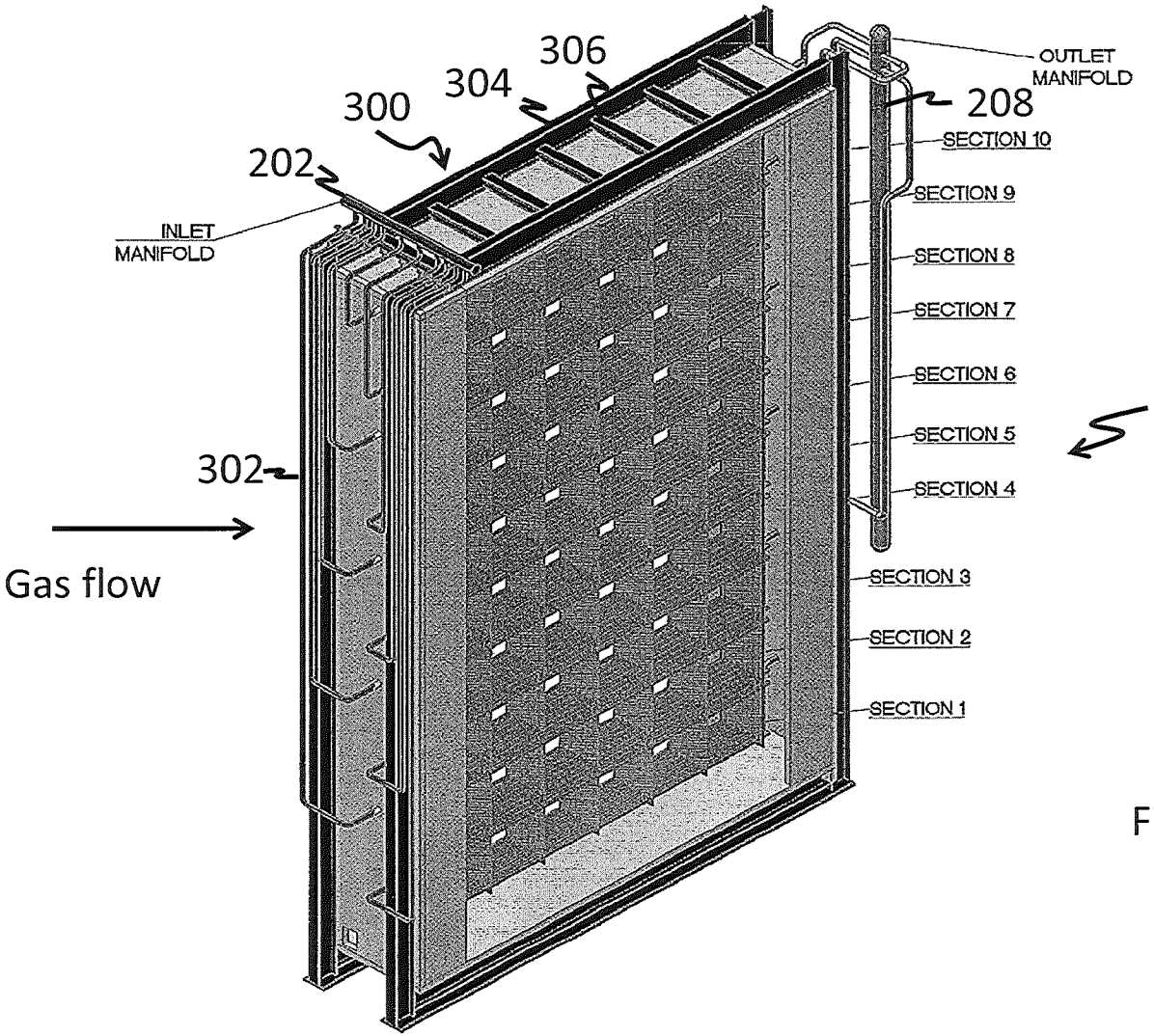
FIG. 4 is an isometric view of an assembled once-through evaporator having 10 tube stacks.

The FIGS. 3(A), 3(B) and 4 depicts assembled views of the once-through evaporator 200. The control system 400 is not depicted in these views and they are included for purposes of depicting to the viewer the overall once-through evaporator and the flow of the hot gases with respect to the evaporator.

The FIG. 3(A) depicts a plurality of vertically aligned tube stacks 210(*n*) that have a passage 239 disposed between them. A baffle system 240 is disposed between in the passage 239 to deflect the incoming hot gases into the upper and/or lower tube stacks. The use of inclined tubes provides unoccupied space 270 in the once-through evaporator. This unoccupied space 270 can be used to house fractional tube stacks, control systems, start-up systems, or baffle systems. The FIG. 3(B) depicts a two vertically aligned tube sections 210(*n*) that have a plurality of tubes supported by a plurality of plates 250. Each of the tube sections are in fluid communication with an inlet header 204(*n*) and an outlet header 206(*n*). A working fluid travels from the inlet header 204(*n*) to the outlet header 206(*n*) via the respective tube stacks 210(*n*). As can be seen from the FIG. 3(B), the hot gas flow is substantially horizontal and perpendicular to the flow of fluid in the tube stacks.

The FIG. 4 depicts another assembled once-through evaporator. The FIG. 4 shows a once-through evaporator having 10 vertically aligned tube stacks 210(*n*) through which hot gases can pass to transfer their heat to the working fluid passing through the tubes of the tube stack 210(*n*). The tube stacks are mounted in a frame 300 that comprises two parallel vertical support bars 302 and two horizontal support bars 304. The support bars 302 and 304 are fixedly attached or detachably attached to each other by welds, bolts, rivets, screw threads and nuts, or the like.

Disposed on an upper surface of the once-through evaporator are rods 306 that contact the plates 250. Each rod 306 supports the plate and the plates hang (i.e., they are suspended) from the rod 306. The plates 250 (as detailed above) are locked in position using clevis plates. The plates 250 also support and hold in position the respective tube stacks 210(*n*). In this FIG. 4, only the uppermost tube and the lowermost tube of each tube tack 210(*n*) is shown as part of the tube stack. The other tubes in each tube stack are omitted for the convenience of the reader and for clarity's sake.

Since each rod 306 holds or supports a plate 250, the number of rods 306 are therefore equal to the number of the plates 250. In one embodiment, the entire once-through evaporator is supported and held-up by the rods 306 that contact the horizontal rods 304. In one embodiment, the rods 306 can be tie-rods that contact each of the parallel horizontal rods 304 and support the entire weight of the tube stacks. The weight of the once-through evaporator is therefore supported by the rods 306.

Each section is mounted onto the respective plates and the respective plates are then held together by tie rods 306 at the periphery of the entire tube stack. A number of vertical plates support these horizontal heat exchangers. These plates are designed as the structural support for the module and provide support to the tubes to limit deflection. The horizontal heat exchangers are shop assembled into modules and shipped to site. The plates of the horizontal heat exchangers are connected to each other in the field.

With reference now once again to the FIG. 2, the evaporator 200 comprises an inlet manifold 202, which receives a working fluid from an economizer (not shown) and transports the working fluid to a plurality of inlet headers 204(*n*), each of which are in fluid communication with vertically aligned tube stacks 210(*n*) comprising one or more tubes that are substantially horizontal. The fluid is transmitted from the inlet headers 204(*n*) to the plurality of tube stacks 210(*n*). For purposes of simplicity, in this specification, the plurality of inlet headers 204(*n*), 204(*n*+1) . . . and 204(*n*+n'), depicted in the figures are collectively referred to as 204(*n*). Similarly the plurality of tube stacks 210(*n*), 210(*n*+1), 210(*n*+2) . . . and 210(*n*+n') are collectively referred to as 210(*n*) and the plurality of outlet headers 206(*n*), 206(*n*+1), 206(*n*+2) . . . and 206(*n*+n') are collectively referred to as 206(*n*), and so on.

As can be seen in the FIG. 2, multiple inlet tube stacks 210(*n*) are vertically aligned between a plurality of inlet headers 204(*n*) and outlet headers 206(*n*). Each tube of the tube stack 210(*n*) is supported in position by a plate (not shown). The working fluid upon traversing the tube stack 210(*n*) is discharged to the separator 208 from which it is discharged to the superheater. The inlet manifold 202 and the separator 208 can be horizontally disposed or vertically disposed depending upon space requirements for the once-through evaporator. The FIG. 2 shows a vertical inlet manifold.

The hot gases from a furnace or boiler (not shown) travel perpendicular to the direction of the flow of the working fluid in the tubes 210. The hot gases flow through the respective tube stacks 210(*n*) into the plane of the paper either towards the reader or away from the reader. The once-through evaporator (hereinafter "evaporator") comprises parallel tubes that are disposed horizontally in a direction that is perpendicular to the direction of flow of heated gases emanating from a furnace or boiler. The parallel tubes are serpentine in shape and the working fluid travels from inlet header to outlet header in directions in adjacent tubes that are parallel to each other but opposed in flow. In other words, the working fluid travels in one direction in a first section of the tube and then in an opposed direction in a second section of the tube that is adjacent and parallel to the first section but connected to it. This flow arrangement is termed counter flow since the fluid flows in opposite directions in different sections of the same tube.

Heat is transferred from the hot gases to the working fluid to increase the temperature of the working fluid and to possibly convert some or all of the working fluid from a liquid to a vapor. Details of each of the components of the once-through evaporator are provided below.

As seen in the FIG. 2, the inlet header comprises one or more inlet headers 204(*n*), 204(*n*+1) . . . and (204(*n*) (hereinafter represented generically by the term "204(*n*)"), each of which are in operative communication with an inlet manifold 202. In one embodiment, each of the one or more inlet headers 204(*n*) are in fluid communication with an inlet manifold 202. The inlet headers 204(*n*) are in fluid communication with a plurality of horizontal tube stacks 210(*n*), 210(*n*+1), 210(*n'*+2) . . . and 210(*n*) respectively ((hereinafter termed "tube stack" represented generically by the term "210(*n*)"). Each tube stack 210(*n*) is in fluid communication with an outlet header 206(*n*). The outlet header thus comprises a plurality of outlet headers 206(*n*), 206(*n*+1), 206(*n*+2) . . . and 206(*n*), each of which is in fluid communication with a tube stack 210(*n*), 210(*n*+1), 210(*n*+2) . . . and 210(*n*) and an inlet header 204(*n*), 204(*n*+1), (204(*n*+2) . . . and (204(*n*) respectively.

The terms 'n'' is an integer value, while "n'" can be an integer value or a fractional value. n' can thus be a fractional value such as ½, ⅓, and the like. Thus for example, there can therefore one or more fractional inlet headers, tube stacks or outlet headers. In other words, there can be one or more inlet headers and outlet headers whose size is a fraction of the other inlet headers and/or outlet headers. Similarly there can be tube stacks that contain a fractional value of the number of tubes that are contained in another stack. It is to be noted that the valves and control systems having the reference numeral n' do not actually exist in fractional form, but may be downsized if desired to accommodate the smaller volumes that are handled by the fractional evaporator sections.

There is no limitation to the number of tube stacks, inlet headers and outlet headers that are in fluid communication with each other and with the inlet manifold and the separator. Each tube stack is also termed a zone.

The start-up system 400 uses a flow control device 212(*n*) in each of the supply lines that emanate from the common manifold. In the FIG. 2, each fluid supply line 214(*n*) between the inlet manifold 202 and the inlet headers 204(*n*) is provided with a flow control device 212(*n*). In one embodiment, the flow control device is a control valve. Control valves are valves that used to control conditions such as flow, pressure, temperature, and liquid level by fully or partially opening or closing in response to signals received from controllers that compare a "setpoint" to a "process variable" whose value is provided by sensors that monitor changes in such conditions. The opening or closing of control valves is usually done automatically by electrical, hydraulic or pneumatic actuators (not shown). Positioners may be used to control the opening or closing of the actuator based on electric or pneumatic signals.

These control valves therefore function as variable orifices and when the load on a particular evaporator section varies from a given set point on a process variable curve, the valve either opens or closes to permit more or less working fluid respectively into the evaporator section. By doing this a greater balance is maintained in the particular evaporator section. The valves are selected from the group consisting of ball valves, sluice valves, gate valves, globe valves, diaphragm valves, rotary valves, piston valves, or the like. One or more valves may be used in a single line if desired. As noted above, each valve is fitted with an actuator. Alternatively, a choking device array (not shown) can be installed on each supply pipe to facilitate proper flow distribution and compensation for changes in operating conditions.

The start-up system 400 comprises at least two flow control devices 224 and 226 that are in fluid communication with at least one of the tube stacks 210(*n*) and that are installed at the outlet on at least one of the tube stacks 210(*n*). As noted above, the start-up system 400 also comprises at least one flow control device 212(*n*) that is in fluid communication with the same tube stack 210(*n*) but is located upstream of the tube stack 210(*n*). In one embodiment, the start-up system 400 can be in fluid communication with at two or more of the tube stacks 210(*n*) and that are installed at the outlet on at least one of the tube stacks 210(*n*). The start-up system does not have to be in fluid communication with the outermost tube stack as shown in the FIG. 2, but can be in fluid communication with one or more of the intermediate stacks. While the flow control device 212(*n*) is depicted as being installed in each flow line 214(*n*), there can be flow lines that do not contain flow control devices 212(*n*).

Flow control device 226 is installed on the line 229, which is in fluid communication with the separator 208, while flow control device 224 is installed on a separator bypass line 230.

The flow control devices 224 and 226 are block valves. A block valve is technically any valve that has the capacity to block movement in one or more directions. The most common type of block valve is the simple gate valve although there are hundreds of different variations. The block valves are capable of opening or closing to regulate the flow of fluid to any desired value. Additionally, a corresponding startup separator is also applicable in lieu of a direct bypass system. Thus, when the flow control device 226 is fully opened, the working fluid flows to the separator 208, while when the flow control device 224 is opened the working fluid bypasses the separator 208. Intermediate conditions can also exist wherein a portion of flow is supplied to the separator 208 and to the bypass line.

The flow control devices 224 and 226 and at least one of the control valves 212(*n*) are in operative communication with a controller 228. In an exemplary embodiment, the controller 228 is a thermal controller. Alternatively, the thermal controller can be replaced by a thermal sensor that is in communication with a separate controller. In an exemplary embodiment, the flow control devices 224 and 226 and at least one of the control valves 212(*n*) are in electrical communication with a controller 228. The controller 228 may also use pressure (via pressure sensors), mass flow rate (via mass flow sensors), volumetric flow rate (via volumetric flow sensors), or the like, to control the flow control devices and the control valves. The startup system disclosed herein can also be used with an open loop system.

In one embodiment, the controller 228 measures a temperature of the tube stack 210(*n*) and provides information to the control valves 212(*n*) to regulate the amount of the working fluid that is introduced into the tube stack 210(*n*) that is used in the start-up. The amount of working fluid entering the tube stack 210(*n*) is therefore a function of the information provided by the controller 228.

In an alternative embodiment, the flow control devices 224 and 226 and the control valves 212(*n*) may alternatively be activated and/or controlled by a plurality of sensors, which derive their input from parameters such as pressure, temperature, mass flow rate, phase separation of the working fluid. In one embodiment, the sensor is a pressure sensor. In another embodiment, the sensor can be a temperature sensor. Mass and/or volumetric flow controllers, optical devices that measure phase differences, and the like can also be used to provide input to the controller. It is to be noted that while the control system 400 in the FIG. 2 is only in fluid communication with the tube stack 210(*n*+n'), it can be in fluid communication with one or more tube stacks if desired.

In one embodiment, in one method of operating the start-up system 400, when there are very low loads, the control valves 212(*n*) can serve to restrict the flow to the tube stack 210(*n*). The working fluid is heated in each of the tube stacks 210(*n*). Low amounts of steam that are generated in the tube stacks 210(*n*+n') that are in communication with the control system 400 are discharged to the separator 208 via the flow control device 226, while the flow control device 224 is closed. The low volume of steam generated as a result of the restricted flow to the tube stack 210(*n*+n') is therefore directed to the downstream equipment (i.e., the superheater) via the separator 208 permitting the temperature to be raised gradually so that thermal shock and subsequent damage to the equipment is avoided. The separator 208 is operative to separate the steam from the water in the steam generated in the tube stacks.

It is to be noted that while it is generally desirable to have the flow control device 224 closed when low quality steam is being generated during the startup of the once-through evaporator 200, there are certain circumstances where the flow control device 224 and the flow control device 226 may be kept open during start-up. In one embodiment, the bypass flow control device 224 may be gradually opened during start-up, while the flow control device 226 is fully opened.

When low quality steam is generated (i.e., low temperature steam that contains a large percentage of moisture) it is transported to the separator 208 via the flow control device 226. The separator 208 contains a larger percentage of water when low quality steam is being generated during startup. During this stage of the startup, the low temperature steam generated in the other tube stacks (e.g., 210(*n*), 210(*n*+1), 210(*n*+2), etc.) is discharged to the separator 208 at a point that is higher than the liquid level in the separator 208. The separator 208 separates low quality steam from high quality of steam.

Fluid temperature signals at the outlet end of each respective tubes of the tube stack 210(*n*) can be used to tune the desired temperature. Similarly, a pressure differential (or other feedback signal) can also be used to achieve the same end result.

Once sufficient steam (i.e., high quality steam) is generated in the tube stack 210(*n*+n') or in the entire tube stack 210(*n*), the separator bypass flow control device 224 is opened to provide steam to the superheater equipment that lies downstream of the separator, while at the same time closing flow control device 226. This avoids remixing of superheated steam with water and/or partial quality of fluid in the mixing chamber (not shown) and can thus provide more net steam to the equipment that lies downstream of the tube stack 210(*n*).

As higher quality steam is increasingly generated in all of the other tube stacks (e.g., 210(*n*), 210(*n*+1), 210(*n*+2), etc.), it travels via the bypass to the downstream equipment. Water may be drained from the separator 208 by a separate discharge valve (not shown).

The once-through startup section inlet control valves 212 (*n*) can also be adjusted to keep the fluid temperature within an acceptable operating range as load changes occur. In other words, once the devices downstream of the tube stack 210(*n*) such as the separator, the superheater and the like, have reached their desired temperatures according to a desired heating profile, the valves 212(*n*) on the device can be opened to their normal operating range as per the requirements of the once-through evaporator. The balance of the once-through sections (non startup system related equipment) reaches the once-through mode in keeping with the associated equipment requirements.

It is to be noted that this application is being co-filed with Patent Applications having Alstom docket numbers W11/122-1, W12/001-0, W11/123-1, W12/093-0, W11/120-1, W11/121-0 and W12/110-0, the entire contents of which are all incorporated by reference herein.

The present invention also contemplates that the dynamically controlled flow control devices described herein may be combined with static flow chocking devices as described in a corresponding provisional patent application, filed contemporaneously with the present patent application, having an ALSTOM attorney docket number of W11/120-0, which are incorporated herein by reference in their entirety.

Maximum Continuous Load" denotes the rated full load conditions of the power plant.

"Once-through evaporator section" of the boiler used to convert water to steam at various percentages of maximum continuous load (MCR).

"Approximately Horizontal Tube" is a tube horizontally orientated in nature. An "Inclined Tube" is a tube in neither a horizontal position or in a vertical position, but dispose at an angle therebetween relative to the inlet header and the outlet header as shown.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, singular forms like "a," or "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

The term and/or is used herein to mean both "and" as well as "or". For example, "A and/or B" is construed to mean A, B or A and B. The transition term "comprising" is inclusive of the transition terms "consisting essentially of" and "consisting of" and can be interchanged for "comprising".

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A once-through evaporator comprising:

an inlet manifold;

one or more inlet headers in fluid communication with the inlet manifold;

one or more tube stacks, where each tube stack comprises one or more substantially horizontal evaporator tubes; the one or more tube stacks being in fluid communication with the one or more inlet headers; where one or more tube stacks are used for a start-up of the once-through evaporator;

one or more outlet headers in fluid communication with one or more tube stacks;

a separator in fluid communication with the one or more outlet headers;

a first flow control device in fluid communication with the separator and at least one of the tube stacks used for start-up;

a second flow control device in fluid communication with a superheater and at least one of the tube stacks used for startup to bypass the separator; and a controller for controlling the actuation of the first and second flow control devices in response to a parameter of the evaporator.

2. The once-through evaporator of claim 1, wherein the controller is a thermal controller that provides a signal indicative of the output temperature of the at least one tube stack used for start-up.

3. The once-through evaporator of claim 1, further including a control valve in fluid communication with the inlet manifold and the tube stack to control the fluid flow therebetween in response a signal provided by the controller.

4. The once-through evaporator of claim 1, wherein the controller is a pressure controller, a mass or volumetric rate flow controller, a phase change controlling device, or a combination thereof.

5. The once-through evaporator of claim 1, wherein a single tube stack is used in the start-up.

6. The once-through evaporator of claim 1, wherein the first flow control device is a block valve.

7. The once-through evaporator of claim 1, wherein the second flow control device is a block valve.

8. The once-through evaporator of claim 1, wherein a plurality of tube stacks is used for the start-up.

9. The once-through evaporator of claim 1, wherein a plurality of tube stacks are disposed vertically.

10. The once-through evaporator of claim 1, further includes a horizontal duct for directing heated gas through the one or more tube stacks.

11. The once-through evaporator of claim 1, wherein the parameter of the evaporator is the temperature of the working fluid in the tube stack.

12. The once-through evaporator of claim 1, wherein the one or more tube stacks used for a start-up of the once-through evaporator is one or more intermediate tube stacks.

13. The once-through evaporator of claim 1, wherein the one or more tube stacks used for a start-up of the once-through evaporator is an outer-most tube stack.

14. A method comprising:

discharging a working fluid through a once-through evaporator; where the once-through evaporator comprises:

an inlet manifold;

one or more inlet headers in fluid communication with the inlet manifold;

one or more tube stacks, where each tube stack comprises one or more substantially horizontal evaporator tubes; the one or more tube stacks being in fluid communication with the one or more inlet headers; where one or more tube stacks are used for a start-up of the once-through evaporator;

one or more separators in fluid communication with one or more tube stacks;

a separator in fluid communication with the one or more outlet headers;

a first flow control device in fluid communication with the separator and at least one of the tube stacks used for start-up;

a second flow control device in fluid communication with a superheater and at least one of the tube stacks used for startup to bypass the separator; and a controller for controlling the actuation of the first and second flow control devices in response to a parameter of the evaporator;

measuring a temperature of the working fluid in the tube stack; and controlling and opening of the first flow control device and/or the second flow control device based on the parameter of the evaporator.

15. The method of claim 14, further comprising opening the first flow control device and the second flow control device at low loads.

16. The method of claim 14, further comprising closing the first flow control device and opening the second flow control device as the working fluid superheats.

17. The method of claim 14, further comprising closing the second flow control device and opening the first flow control device as the working fluid superheats.

18. The method of claim 14, wherein the parameter of the evaporator is the temperature of the working fluid in the tube stack.

19. The method of claim 14, further comprising opening the second flow control device as the working fluid superheats.

20. The method of claim 14, further comprising closing the second flow control device as the working fluid superheats.

* * * * *